US006095883A

United States Patent [19]

Elizondo et al.

[11] Patent Number: 6,095,883

[45] Date of Patent: Aug. 1, 2000

[54] SPATIALLY UNIFORM DEPOSITION OF POLYMER PARTICLES DURING GATE ELECTRODE FORMATION

[75] Inventors: Philip J. Elizondo; Kishore K. Chakravorty, both of San Jose; David Caudillo, Saratoga, all of Calif.

[73] Assignee: Candlescent Technologies Corporation, San Jose, Calif.

[21] Appl. No.: 08/963,010

[22] Filed: Nov. 3, 1997

Related U.S. Application Data

[63] Continuation-in-part of application No. 08/889,622, Jul. 7, 1997.

[51] Int. Cl.[7] ..... H01J 9/02

[52] U.S. Cl. ..... 445/49

[58] Field of Search ..... 445/24, 50, 49

[56] References Cited

U.S. PATENT DOCUMENTS

| | | | |
|---|---|---|---|
| 5,199,917 | 4/1993 | MacDonald et al. | 445/24 |
| 5,219,310 | 6/1993 | Tomo et al. | 445/24 |
| 5,504,385 | 4/1996 | Jin et al. | 313/310 |
| 5,601,466 | 2/1997 | Shen et al. | 445/24 |
| 5,865,657 | 2/1999 | Haven et al. | 445/50 |
| 5,865,659 | 2/1999 | Ludwig et al. | 445/50 |

*Primary Examiner*—Kenneth J. Ramsey
*Attorney, Agent, or Firm*—Wagner Murabito & Hao LLP

[57] ABSTRACT

A method for uniformly depositing of polymer particles onto the surface of a gate metal during the formation of a gate electrode. In one embodiment, the present invention comprises immersing a substrate having a layer of a gate metal disposed over the surface thereof in a fluid bath containing polymer particles. In this embodiment, the fluid bath is contained within a fluid bath tank. Additionally, in the present embodiment, the layer of the gate metal disposed over the substrate has a thickness approximately the same as a desired thickness of the gate electrode to be formed. Next, the present embodiment applies a uniform potential across the surface of the layer of gate metal such that the polymer particles are uniformly deposited onto the layer of the gate metal. In so doing, the present embodiment uniformly deposits the polymer particles onto the layer of the gate metal. In the present embodiment, the polymer particles adhere to the surface of the layer of the gate metal via Van der Waal's forces and/or via a charge difference between the layer of the gate metal and each of the polymer particles. In this embodiment, the polymer particles are deposited over the surface of the layer of the gate metal with a spatial density of approximately 1×108 to $1\times10^{12}$ particles per square centimeter. The present embodiment then removes the substrate having the layer of the gate metal and the particles deposited thereon from the fluid bath.

21 Claims, 15 Drawing Sheets

SPATIALLY UNIFORM DEPOSITION OF POLYMER PARTICLES DURING GATE ELECTRODE FORMATION

This application is Continuation-in-Part of co-pending, commonly-owned U.S. patent application Ser. No. 08/889,622 to Chakravorty et al., entitled "Gate Electrode Formation Method", filed Jul. 7, 1997.

FIELD OF THE INVENTION

The present claimed invention relates to the field of flat panel displays. More particularly, the present claimed invention relates to the formation of a gate electrode for a flat panel display screen structure.

BACKGROUND ART

In certain flat panel display devices such as, for example, flat display devices utilizing cold cathodes, a gate electrode is required. In such flat panel display devices, an electron emissive cold cathode is disposed between a first electrode (e.g. a row electrode) and a second electrode (e.g. a gate electrode). By generating a sufficient voltage potential between the row electrode and the gate electrode, the electron emissive cold cathode is caused to emit electrons. In one approach, the emitted electrons are accelerated, through openings in the gate electrode, towards a display screen. In such flat panel display devices, it is desirable to have large population of the openings uniformly and consistently arranged, with sufficient spacing provided between each opening to avoid overlapping, across the surface of the gate electrode.

With reference now to Prior Art FIG. 1, a side sectional view of a conventional process step used in the formation of a prior art gate electrode is shown. As shown in Prior Art FIG. 1, a first electrode 102 has an insulating layer 104 disposed thereon. In a conventional gate electrode formation process, a non-insulating material is deposited on top of insulating layer 104 to form a very thin non-insulating layer 106 (e.g. on the order of 100 angstroms) of the non-insulating material.

With reference now to Prior Art FIG. 2, conventional gate electrode formation processes then deposit spheres, typically shown as 108, onto very thin non-insulating layer 106. Because layer 106 is very thin, it is extremely difficult for such prior art gate electrode formation processes to make very thin non-insulating layer 106 continuous. As a result, spheres 108 are not uniformly or consistently deposited across the surface of very thin non-insulating layer 106 in conventional gate electrode formation processes.

With reference next to Prior Art FIG. 3, a second layer of non-insulating material 110 is then deposited over the very thin non-insulating layer 106 and over spheres 108. As shown in Prior Art FIG. 3, second layer of non-insulating material 110 is much thicker than very thin layer of non-insulating material 106. In such prior art approaches, very thin non-insulating layer 106 together with second non-insulating layer 110 comprise the body of the gate electrode.

As shown in Prior Art FIG. 4, after the deposition of second non-insulating layer 110, spheres 108 and portions of second non-insulating layer 110 which overlie spheres 108 are removed. As a result, regions, typically shown as 112, of very thin non-insulating layer 106 have second non-insulating layer 110 removed therefrom.

Referring still to Prior Art FIG. 4, after the removal of spheres 108 and portions of second non-insulating layer 110 which overlie spheres 108, an etch step is performed. The etch step is used to form openings through very thin non-insulating layer 106. As mentioned above, spheres 108 are not uniformly or consistently disposed across the surface of very thin non-insulating layer 106 in conventional gate electrode formation processes. Consequently, conventionally formed openings in second non-insulating layer 110 and very thin non-insulating layer 106 are likewise not uniformly or consistently disposed across the surface of very thin non-insulating layer 106. In addition to forming openings through second non-insulating layer 110 and very thin non-insulating layer 106, the etch step of conventional gate electrode formation processes also substantially etches second non-insulating layer 110. The etching of second non-insulating layer 110 reduces the thickness thereof. Therefore, second non-insulating layer 110 must be deposited to a thickness which is greater than the desired thickness of the gate electrode, so that second non-insulating layer 110 will be of the desired thickness after being subjected to the etch environment. Thus, conventional gate electrode formation processes reduce the thickness of the gate electrode across the entire surface thereof when etching openings through the gate electrode, as shown in Prior Art FIG. 5.

Referring again to Prior Art FIG. 5, as yet another drawback, during etch steps of the above-described gate electrode formation process, the top surface of second non-insulating layer 110 is subjected to the etch environment. In addition to reducing the thickness of second insulating layer 110, the etch environment induces deleterious effects such as, for example, oxidation at the top surface of second non-insulating layer 110. Oxidation of the top surface of second non-insulating layer 110 complicates other processes such as the removal of subsequently deposited emitter material. Thus, conventional gate electrode formation processes subject the gate electrode to unwanted etching, and degrade the surface integrity of the gate electrode.

As still another drawback, thickness uniformity of the gate film remaining after an etch process crucially depends on the etch uniformity of the etch system employed. In large area panels, such etch non-uniformity is a major concern because it is extremely difficult to achieve sufficient etch uniformity across the large area panels. The problem of etch non-uniformity is further exacerbated when etching through submicron features.

Referring now to Prior Art FIG. 6, a schematic top view of a portion 600 of the surface of very thin non-insulating layer 106 having spheres, typically shown as 108, conventionally deposited thereon is shown. As mentioned above, during conventional gate electrode formation processes, spheres 108 are not uniformly deposited across the surface of very thin non-insulating layer 106. That is, the spacing between neighboring spheres is highly inconsistent. As shown in Prior Art FIG. 6, a particular sphere may be separated by a distance di from one neighboring sphere, separated by a distance $d_2$ from another neighboring sphere, and separated by a distance $d_3$ from still another neighboring sphere. Such non-uniform spacing of spheres 108 is not conducive to the formation of gates holes having small size, high density, and spatially uniform distribution.

Additionally, conventional sphere deposition processes are performed in a fluid bath. After the spheres are deposited onto the surface of very thin non-insulating layer 106 of Prior Art FIGS. 1–6, the sphere coated structure (i.e. very thin non-insulating layer 106 and the substrate underlying very thin non-insulating layer 106) is removed from the bath. However, during conventional bath removal processes, loose spheres may shift position on the surface of very thin non-insulating layer 106, and/or spheres in the fluid bath may detrimentally become deposited onto the surface of very thin non-insulating layer 106. Such unwanted sphere deposition during the removal of the substrate from the bath further renders the location of the spheres non-uniform across the surface of very thin non-insulating layer 106. The deleterious redeposition of the spheres also results in undesired clumping or grouping of the spheres on the surface of very thin non-insulating layer 106.

Many conventional gate electrode formation processes also require the use of harsh and/or caustic materials to remove the spheres from the surface of very thin non-insulating layer 106 during subsequent processing steps. Aside from being potentially damaging to other materials used in the flat panel display, such harsh and/or caustic chemicals are environmentally detrimental. As a result, these chemicals require special handling and/or disposal procedures.

Thus, a need exists for a gate electrode formation method which achieves uniform deposition of spheres. Another need exists for a gate electrode formation process which removes the substrate from a fluid bath without resulting in deleterious settling of loose spheres on the surface of the layer of the gate metal. Yet another need exists for a method which does not require the use of harsh and/or caustic materials to remove the spheres from the surface of the layer of the gate metal.

SUMMARY OF INVENTION

The present invention provides a gate electrode formation method which achieves uniform deposition of spheres. The present invention also provides a gate electrode formation process which removes the substrate from a fluid bath without resulting in deleterious settling of loose spheres on the surface of the layer of the gate metal. The present invention further provides a method which does not require the use of harsh and/or caustic materials to remove the spheres from the surface of the layer of the gate metal.

Specifically, in one embodiment, the present invention comprises immersing a substrate having a layer of a gate metal disposed over the surface thereof in a fluid bath containing polymer particles. In this embodiment, the fluid bath is contained within a fluid bath tank. Additionally, in the present embodiment, the layer of the gate metal disposed over the substrate has a thickness approximately the same as a desired thickness of the gate electrode to be formed. Next, the present embodiment applies a uniform potential across the surface of the layer of gate metal such that the polymer particles are uniformly deposited onto the layer of the gate metal. In so doing, the present embodiment uniformly deposits the polymer particles onto the layer of the gate metal. In the present embodiment, the polymer particles adhere to the surface of the layer of the gate metal via Van der Waal's forces and/or via a charge difference between the layer of the gate metal and each of the polymer particles. In this embodiment, the polymer particles are deposited over the surface of the layer of the gate metal with a spatial density of approximately $1\times10^{8}$ to $1\times10^{12}$ particles per square centimeter. The present embodiment then removes the substrate having the layer of the gate metal and the particles deposited thereon from the fluid bath.

In another embodiment, the present invention includes features of the previous embodiment and further comprises removing the substrate having the layer of the gate metal and the particles deposited thereon from the fluid bath. Specifically, in this embodiment, the present invention maintains a constant vapor pressure in the fluid bath tank while draining the fluid bath from the fluid bath tank. This is accomplished in the present embodiment by controlling the rate at which the fluid bath is drained from the fluid bath tank, and/or by introducing a gas into the fluid bath tank during the draining of the fluid bath from the fluid bath tank. After the deposition of a hard mask layer, the present embodiment further recites directing a high pressure spray at the surface of the layer of the gate metal to remove the polymer particles and portions of the hard mask layer which overlie the polymer particles such that first regions of the layer of the gate metal are exposed, and such that second regions of the layer of the gate metal remain covered by the hard mask layer.

In still another embodiment, the present invention includes features of the above-described embodiments and further comprises etching into the first regions of the layer of the gate metal such that substantially uniformly spaced openings are formed into the layer of the gate metal at the first regions. As a result, the second regions of the layer of the gate metal are protected from the etching by the hard mask layer. The present embodiment then recites removing the remaining portions of the hard mask layer which overlie the second regions of the layer of the gate metal.

These and other features and advantages of the present invention will no doubt become obvious to those of ordinary skill in the art after having read the following detailed description of the preferred embodiments which are illustrated in the various drawing figures.

BRIEF DESCRIPTION OF THE DRAWINGS

The accompanying drawings, which are incorporated in and form a part of this specification, illustrate embodiments of the invention and, together with the description, serve to explain the principles of the invention.

Prior Art

Prior Art

Prior Art

Prior Art

Prior Art

Prior Art

The drawings referred to in this description should be understood as not being drawn to scale except if specifically noted.

DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1:
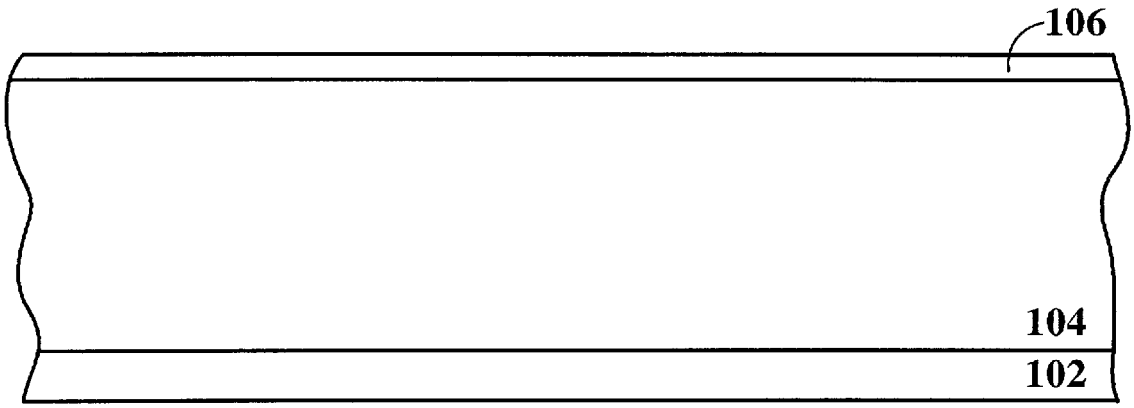
FIG. 1 (Prior Art)
FIG. 1 is a side sectional view illustrating a conventional step used during the formation of a prior art gate electrode.
Figure 2:
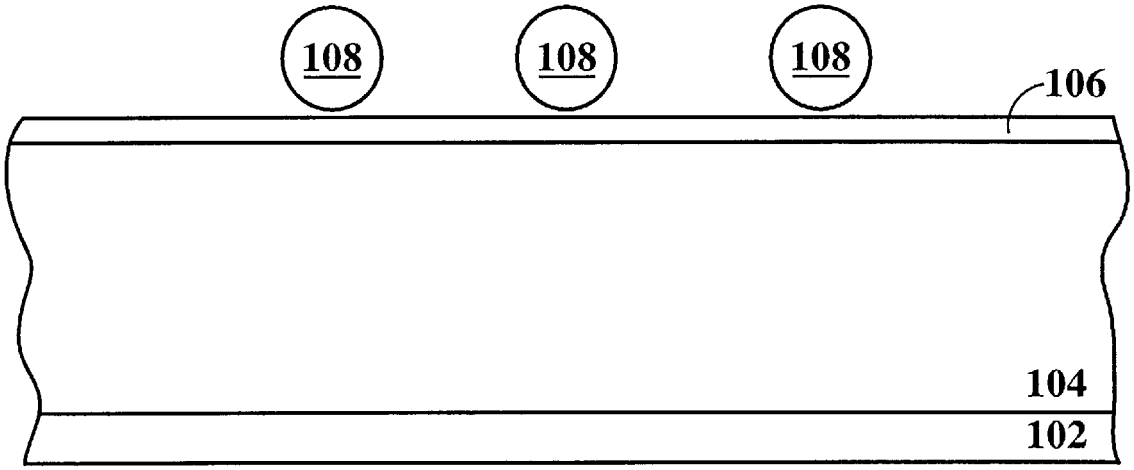
FIG. 2 (Prior Art)
FIG. 2 is a side sectional view illustrating another conventional step used during the formation of a prior art gate electrode.
Figure 3:
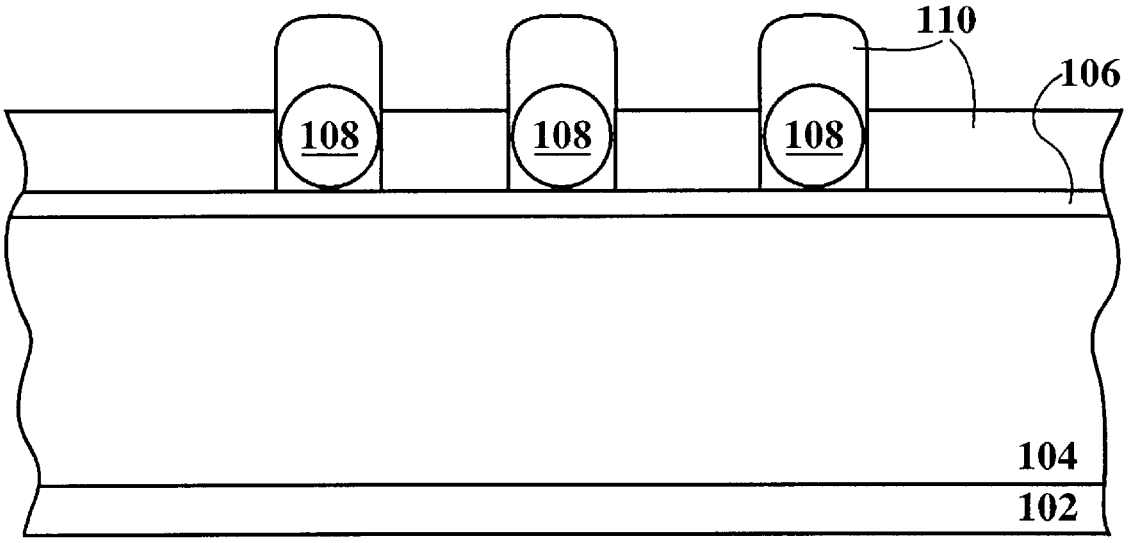
FIG. 3 (Prior Art)
FIG. 3 is a side sectional view illustrating yet another conventional step used during the formation of a prior art gate electrode.
Figure 4:
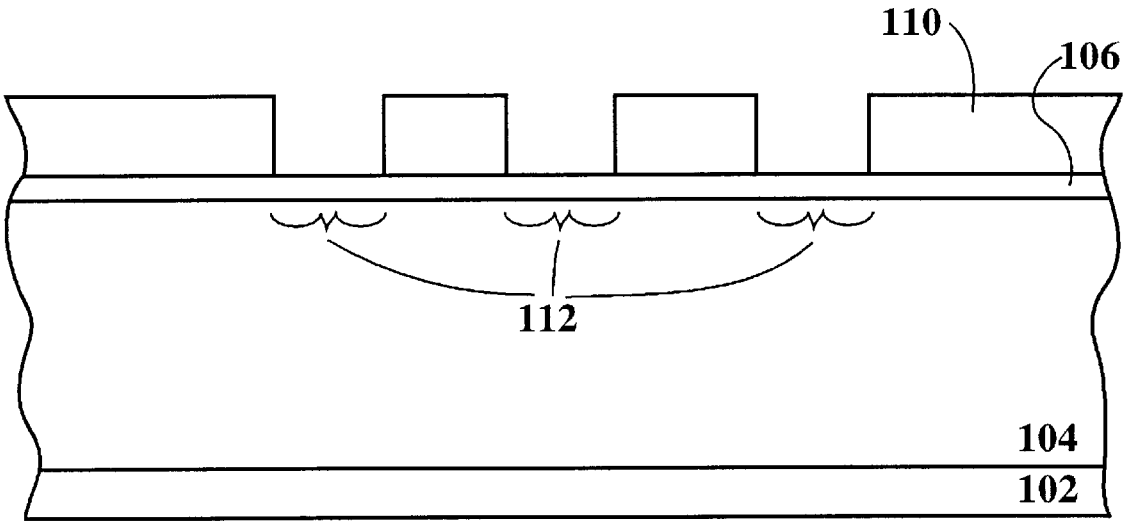
FIG. 4 (Prior Art)
FIG. 4 is a side sectional view illustrating another conventional step used during the formation of a prior art gate electrode.
Figure 5:
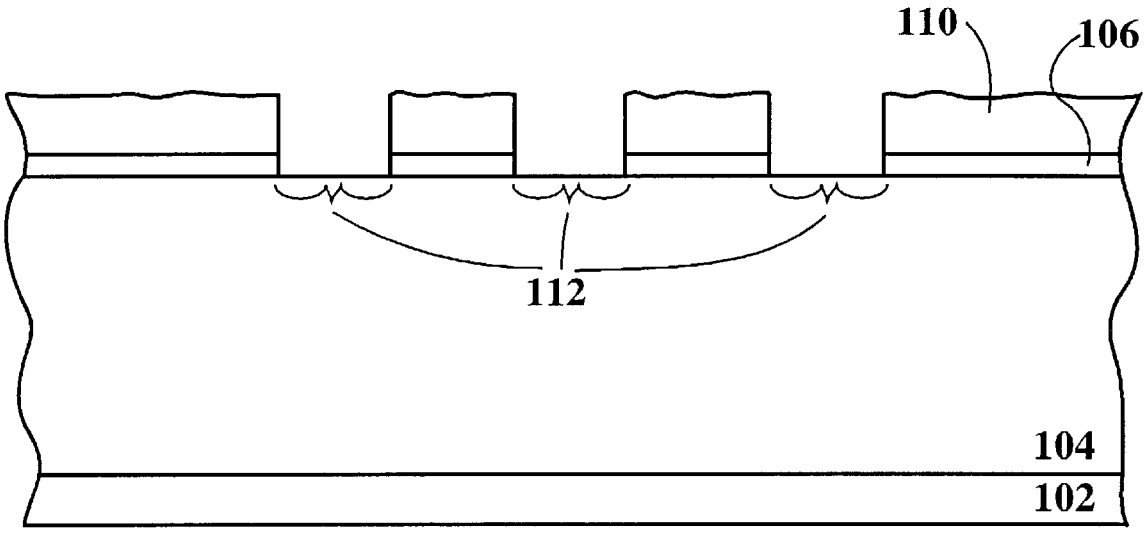
FIG. 5 (Prior Art)
FIG. 5 is a side sectional view illustrating another conventional step used during the formation of a prior art gate electrode.
Figure 6:
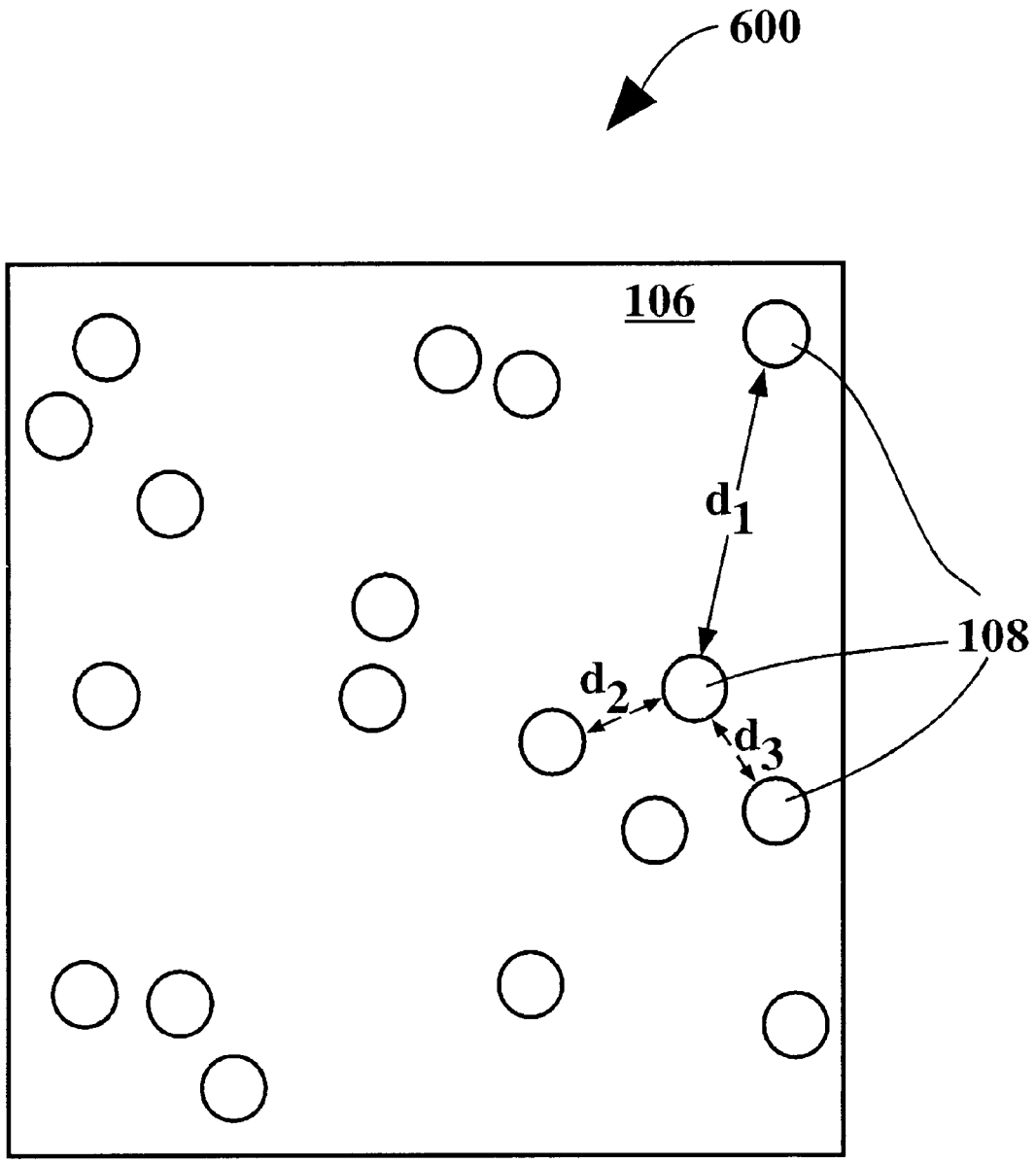
FIG. 6 (Prior Art)
FIG. 6 is a schematic top view of a portion of the surface of a very thin non-insulating layer having spheres conventionally deposited thereon.
Figure 7:
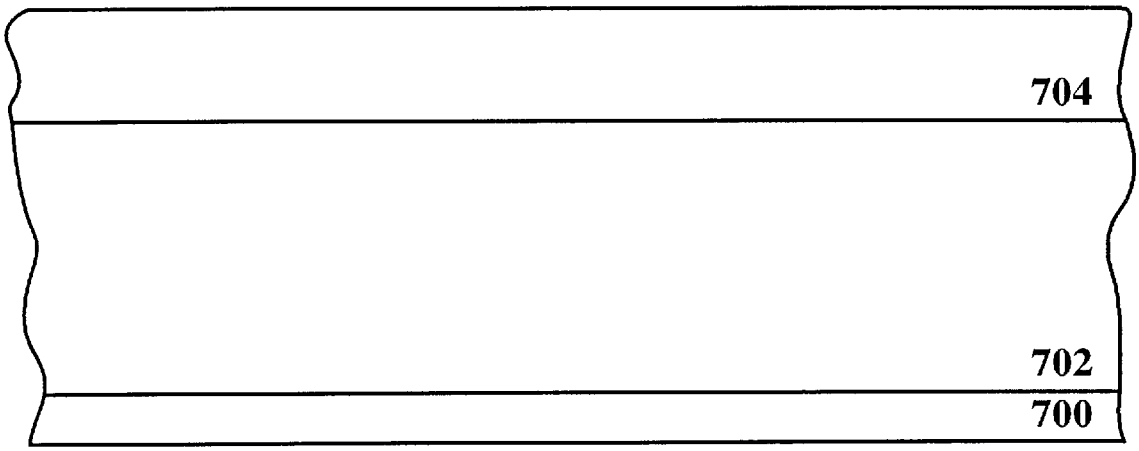
FIG. 7 is a side sectional view illustrating an initial step in the formation of a gate electrode in accordance with the present claimed invention.

With reference to FIG. 7, a side sectional view illustrating a starting step of the present invention is shown. In the present embodiment, a first electrode 700 (e.g. a row electrode) has a layer 702 of dielectric material disposed thereover. In the present embodiment, dielectric layer 702 is comprised of, for example, silicon dioxide. The present invention is, however, well suited to the use of various other dielectric materials. Additionally, although not shown in FIG. 7, the present invention is also well suited for use in an embodiment which includes a resistive layer disposed between row electrode 700 and dielectric layer 702. Such a resistive layer is not shown in FIG. 7 and subsequent figures for purposes of clarity. In the present embodiment, dielectric layer 702 forms an underlying substrate for supporting a gate electrode. Thus, for purposes of the present application, dielectric layer 702 is referred to as the "underlying substrate".

Referring still to FIG. 7, gate metal is deposited over underlying substrate 702 such that a layer 704 of the gate metal is formed above underlying substrate 702. In the present invention, layer 704 of the gate metal is deposited to a thickness approximately the same as a desired thickness of the gate electrode to be formed. That is, unlike prior art gate electrode formation processes, the present invention does not require depositing gate metal to a thickness which is greater than the intended/desired thickness of the gate electrode being formed. In the present embodiment, layer 704 of the gate metal is deposited to a thickness in the range of approximately 300–1000 angstroms. By depositing the gate metal to such a thickness, the present invention achieves a gate metal layer 704 having consistent thickness and uniformity across the entire surface thereof. Hence, the present invention eliminates the very thin and discontinuous metal layers associated with conventional gate electrode formation processes. In one embodiment of the present invention, layer 704 of the gate metal is formed of chromium. In another embodiment, layer 704 of the gate metal is formed of tantalum. Although such metals are specifically recited, the present invention is not limited to the use of only chromium or tantalum.

Figure 8:
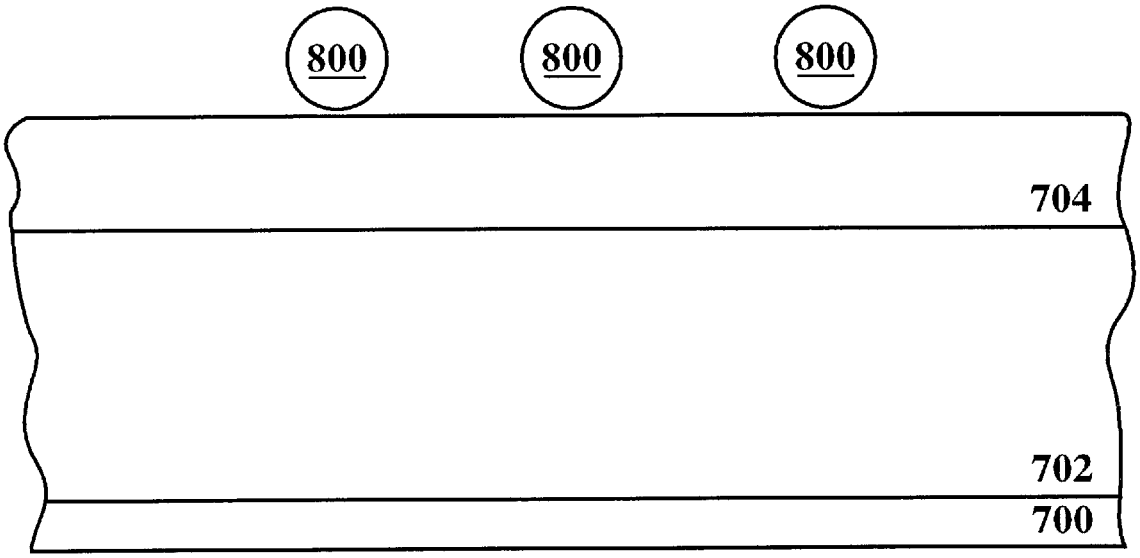
FIG. 8 is a side sectional view illustrating spheres deposited on a layer of a gate metal in accordance with the present claimed invention.

Referring now to FIG. 8, the present invention then deposits polymer particles or "spheres" 800 onto layer 704 as shown. In the present embodiment, the structure of FIG. 7 is immersed in a fluid bath containing polymer particles each having a diameter in the range of 100–150 nanometers. Although such diameter sizes are specifically recited, the present invention is not limited to the use of only those sizes. Furthermore, in the present embodiment, the fluid bath is contained within a fluid bath tank. In the present embodiment, the fluid bath is comprised, for example, of an organic bath such as ethyl alcohol. It will be understood however, that the present invention is well suited to immersing the structure of FIG. 7 in numerous other types of liquid baths. Polymer sphere concentration within the liquid bath is approximately $1.0\times10^{9}$ to $1.0\times10^{11}$ particles per cubic centimeter, in this embodiment. Such a concentration is exemplary, and the present invention is suited to having a higher or lower polymer particle concentration within the liquid bath.

Figure 9:
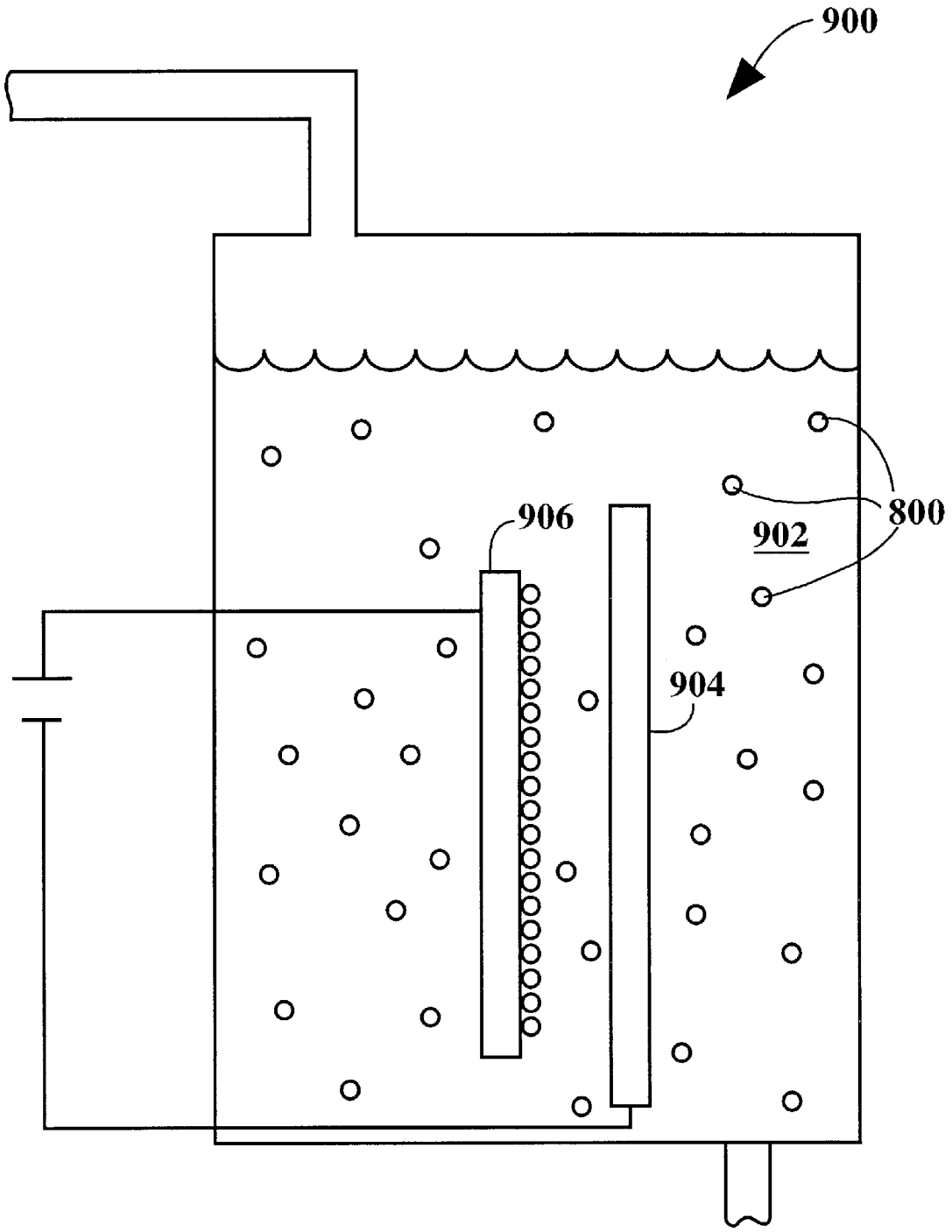
FIG. 9 is a schematic side sectional view of a fluid bath tank containing a fluid bath, polymer particles, an electrode, and the structure of FIG. 7 in accordance with the present claimed invention.

With reference next to FIG. 9, a fluid bath tank 900 containing the fluid bath 902, polymer particles 800, electrode 904, and the structure of FIG. 7 is shown. In the present embodiment, polymer particles 800 are electrically charged as follows. Electrode 904 is disposed within fluid bath 902 adjacent to structure 906 (i.e. the structure of FIG. 7). In the present embodiment, electrode 904 and structure 906 are separated by a distance of approximately 10–100 millimeters and have a potential difference in the range of 5–100 volts. Furthermore, in the embodiment of FIG. 9, structure 906 functions as the positive electrode, and the positive potential is applied across the surface of the layer of the gate metal (layer 704 of FIG. 7). Also, in the present embodiment, the bulk chemistry, surface chemistry, and density of polymer particles 800 are adjusted to resist agglomeration of the polymer particles on the surface of layer 704.

Referring still to FIG. 9, polymer particles 800 are attracted to layer 704 of structure 906, and are electrophoretically bound to the surface thereof. In this invention, polymer particles 800 adhere to layer 704 via Van der Waal's forces, and/or via a charge difference between layer 704 and each respective one of polymer particles 800. As shown in FIG. 9, in the present invention polymer particles are uniformly deposited over the surface of layer 704 of FIG. 7. In the present invention, due to the thick (e.g. 300–1000 angstroms), and hence less resistive, and continuous nature of layer 704, the present invention is able to generate a uniform potential across the surface of layer 704. By applying a uniform potential across the surface of layer 704, polymer particles 800 are uniformly deposited thereon. More specifically, in one embodiment of the present invention, polymer particles 800 are deposited over the surface of layer 704 with a spatial density of approximately $1\times10^{8}$ to $1\times10^{12}$ particles per square centimeter.

Figure 10:
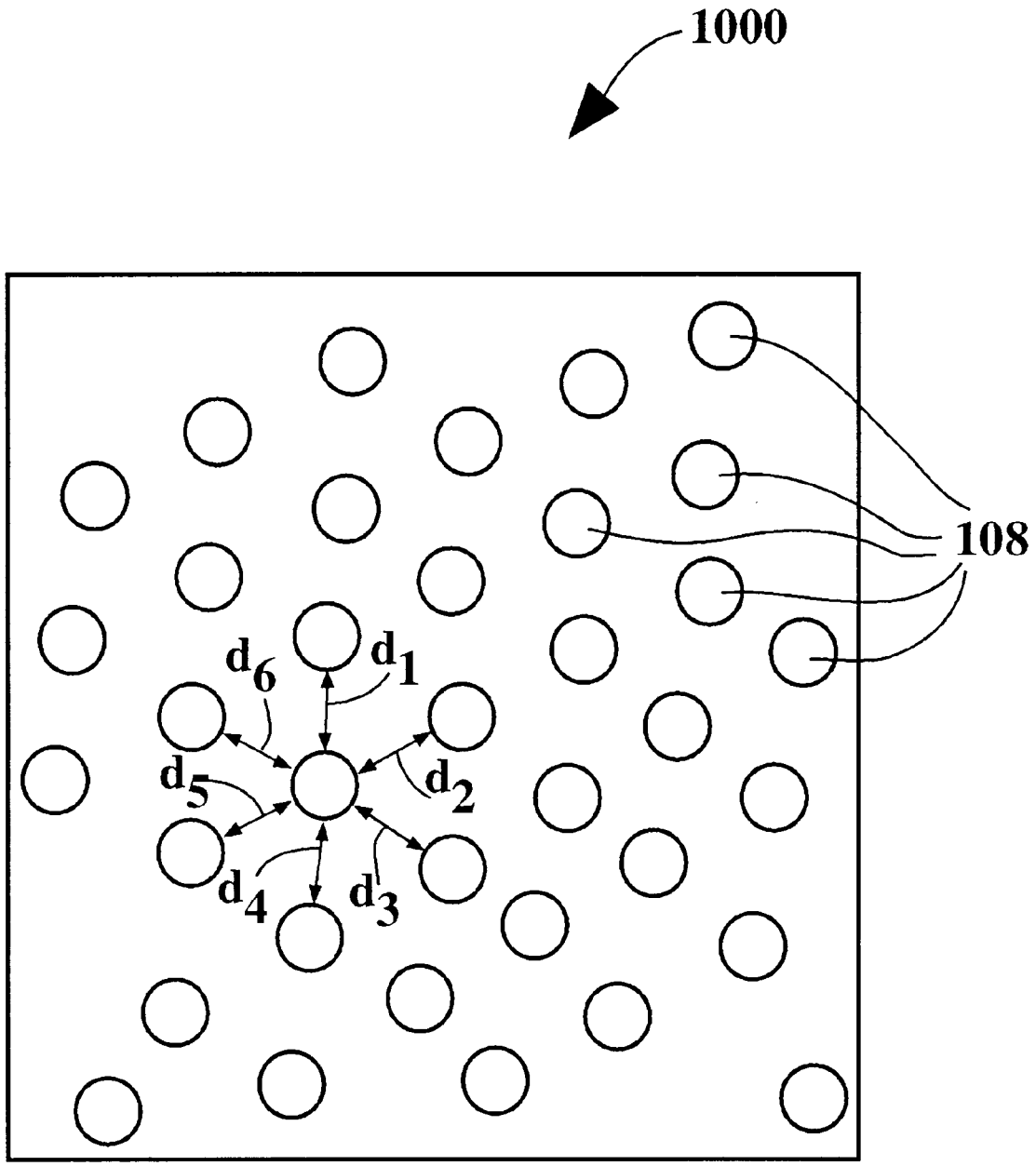
FIG. 10 is a schematic top view of a portion of the surface of the thick gate metal layer having polymer particles uniformly deposited thereon in accordance with the present claimed invention.

With reference now to FIG. 10, a schematic top view of a portion 1000 of the surface of layer 704 of FIG. 7 having polymer particles 800 uniformly deposited thereon is shown. As mentioned above, in the present invention, polymer particles 800 are uniformly deposited across the surface of layer 704. That is, the spacing between neighboring spheres is highly consistent. As shown in FIG. 10, a particular particle may be separated by a distance $D_1$ from one neighboring sphere, separated by a distance $D_2$ from another neighboring sphere, separated by a distance $D_3$ from another neighboring sphere, separated by a distance $D_4$ from another neighboring sphere, separated by a distance $D_5$ from another neighboring sphere, separated by a distance $D_6$ from another neighboring sphere (and so on), where $D_1 \approx D_2 \approx D_3 \approx D_4 \approx D_5 \approx D_6$. Such uniform spacing of polymer particles 800 is very conducive to the formation of gates holes having small size, high density, and spatially uniform distribution. Thus, the present invention improves the uniformity of particle spacing compared to conventional gate electrode formation processes. The uniform deposition of the polymer spheres achieved by the present invention facilitates the formation of evenly distributed gate hole openings. As a result, the present invention achieves uniformly dispersed hard mask holes for a flat panel display device.

Figure 11:
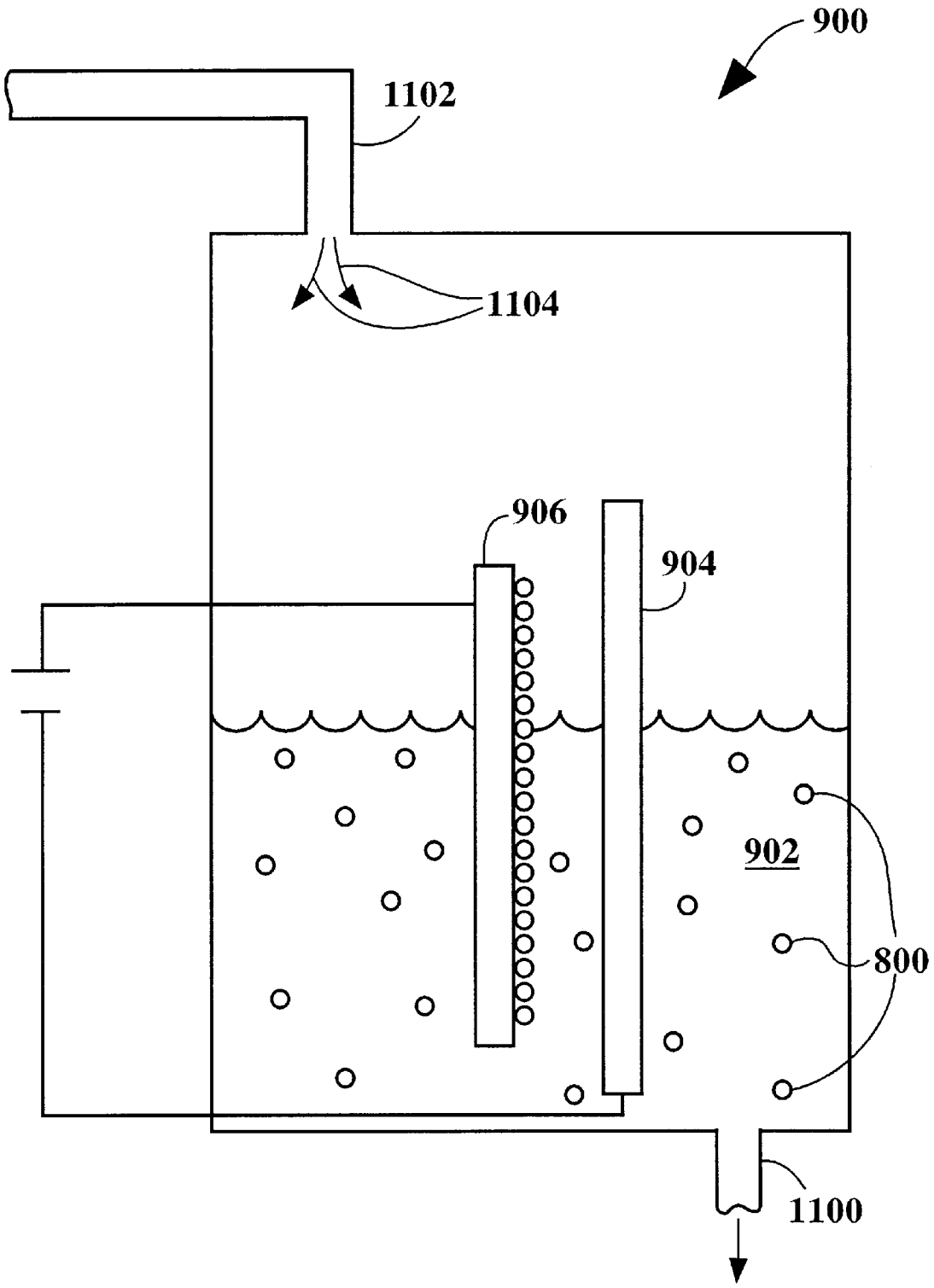
FIG. 11 is a schematic side sectional view of the fluid bath tank of FIG. 9 during a draining thereof in accordance with the present claimed invention.

With reference now to FIG. 11, fluid bath tank 900 is shown during a draining process. In the draining process, after the deposition of polymer particles 800, structure 906 has the fluid bath 902 slowly pulled away therefrom while being subjected to a clean and inert gaseous environment. That is, fluid bath 902 is drained from fluid bath tank 900. Moreover, in the present embodiment, a constant vapor pressure is maintained in fluid bath tank 900 while draining fluid bath 902 therefrom. In the present embodiment, fluid bath 902 is slowly drained at a controlled drain rate from fluid bath tank 900 through drain 1100. Also, a gas (e.g. nitrogen) is introduced into fluid bath tank 900 during the draining of fluid bath 902 from fluid bath tank 900. In the embodiment of FIG. 11, the nitrogen gas is introduced through inlet 1102 as represented by arrows 1104. In so doing, the present invention is able to compensate for the decrease in pressure, resulting from the draining of liquid bath 902, by adding nitrogen to fluid bath tank 900. Thus, the present invention maintains a substantially constant vapor pressure within fluid bath tank 900 even during the draining of fluid bath 902. Additionally, the present invention is well suited to having the nitrogen gas be directed either horizontally or vertically across structure 906 while maintaining a constant vapor pressure within fluid bath tank 900.

Figure 12:
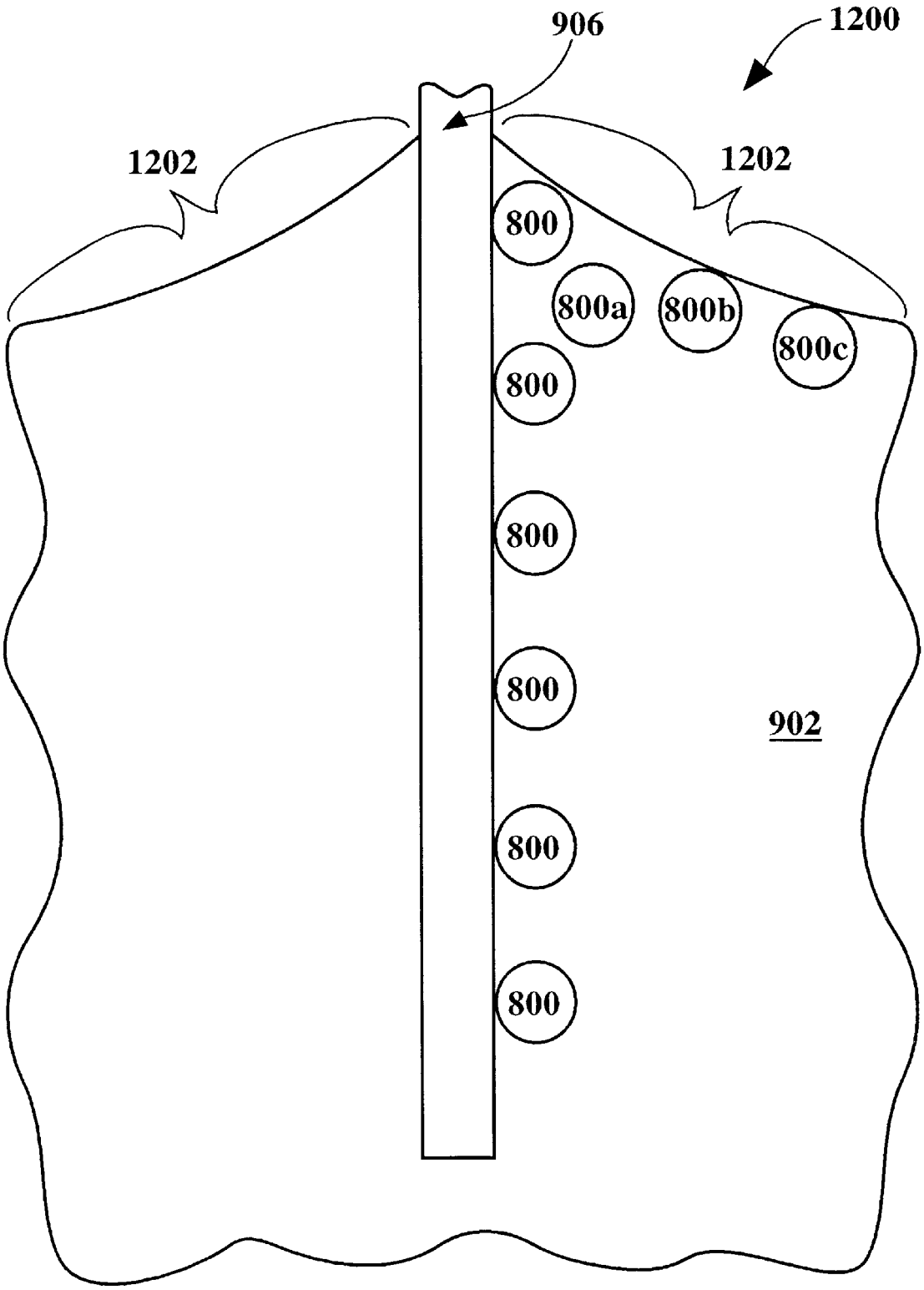
FIG. 12 is a schematic side sectional view 1200 of the interface (i.e. the boundary layer) between a fluid bath and nitrogen gas introduced during a draining process in accordance with the present claimed invention.

Referring next to FIG. 12, a schematic side sectional view 1200 of the interface (i.e. the boundary layer) between fluid bath 902 and the introduced nitrogen gas during the draining process is shown. More specifically, FIG. 12 illustrates the effects of surface tension in the interface between fluid bath 902 and the introduced nitrogen gas at the region 1202 where structure 906 has fluid bath 902 pulled away therefrom. In the present invention, liquid bath 902 is evaporated off of structure 906 uniformly and without collapsing the boundary layer at region 1202. As mentioned previously, during conventional bath removal processes, loose spheres may shift position, and/or loose spheres in the fluid bath may detrimentally become deposited onto the surface of structure 906. However, by maintaining the constant vapor pressure, and by preventing the collapse of the boundary layer at region 1202, the present invention eliminates such deleterious redeposition of loose spheres onto structure 906. That is, in the present invention loose polymer spheres, typically shown as 800*a*, 800*b*, and 800*c*, are pulled away from structure 906 (as indicated by arrow 1204) by surface tension forces. Thus, the loose polymer spheres are drained away without contaminating the surface of structure 906.

Figure 13:
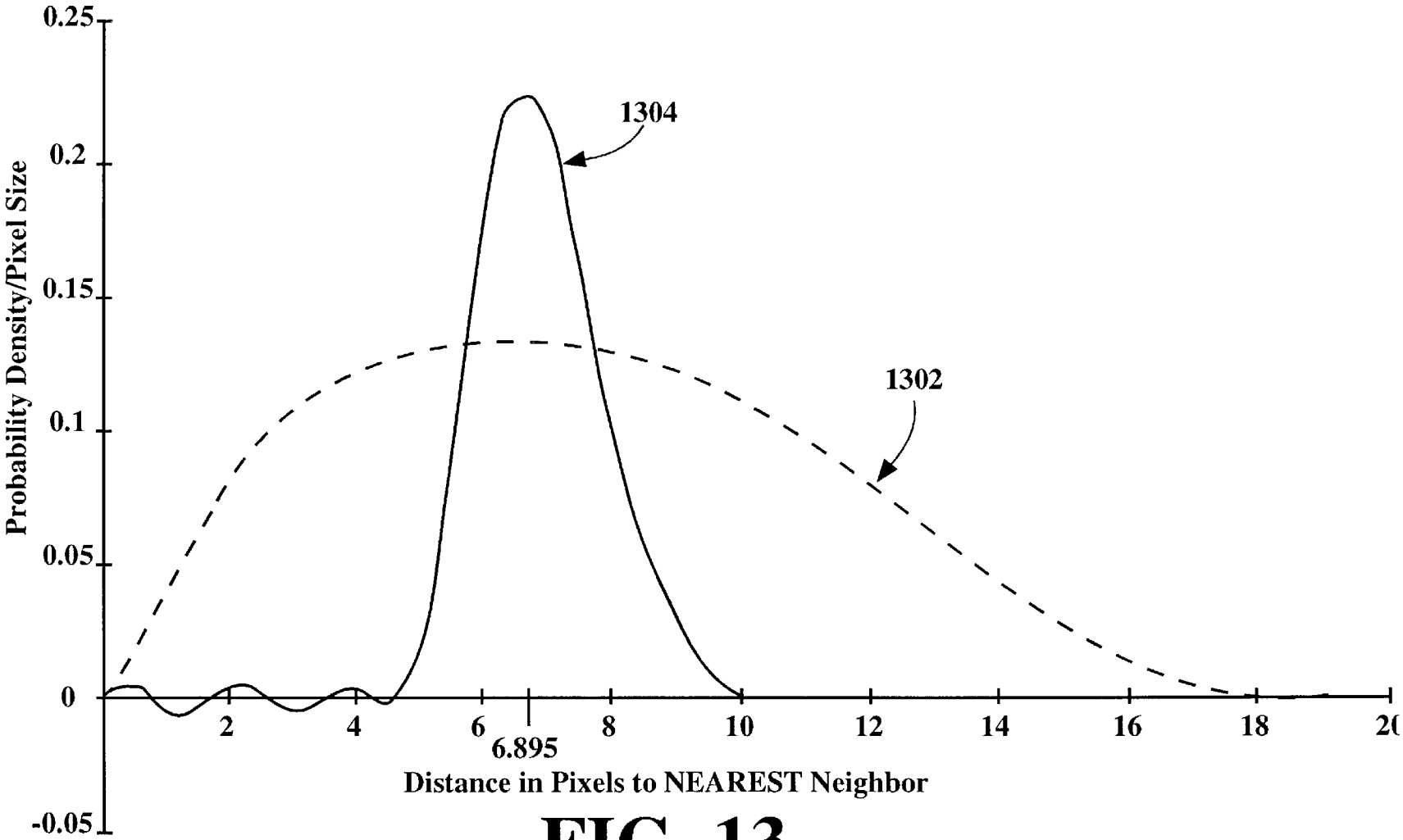
FIG. 13 is a graph illustrating the improved spatial uniformity of deposited polymer spheres in accordance with the present claimed invention.

With reference next to FIG. 13, a graph 1300 illustrating the improved spatial uniformity of the polymer spheres achieved by the present invention is shown. In graph 1300, the x-axis cites the distance in pixels to the nearest neighboring polymer sphere for line 1304, and the y-axis represents the probability density. Line 1302 of graph 1300 illustrates the non uniform spatial distribution associated with prior art gate hole opening formation processes. That is, the spacing between neighboring gate hole openings will be spread over a Poisson distribution. Thus, each gate hole opening may be separated by various distances from neighboring/adjacent gate hole openings. Line 1304 of graph 1300 illustrates the uniform spatial distribution achieved in the present invention. As shown by line 1304, in the present invention, a large probability of the polymer spheres have the same or similar distance to each of their neighboring/adjacent spheres. Thus, as shown in FIG. 10, in the present invention, a uniform spatial distribution is achieved.

Figure 14:
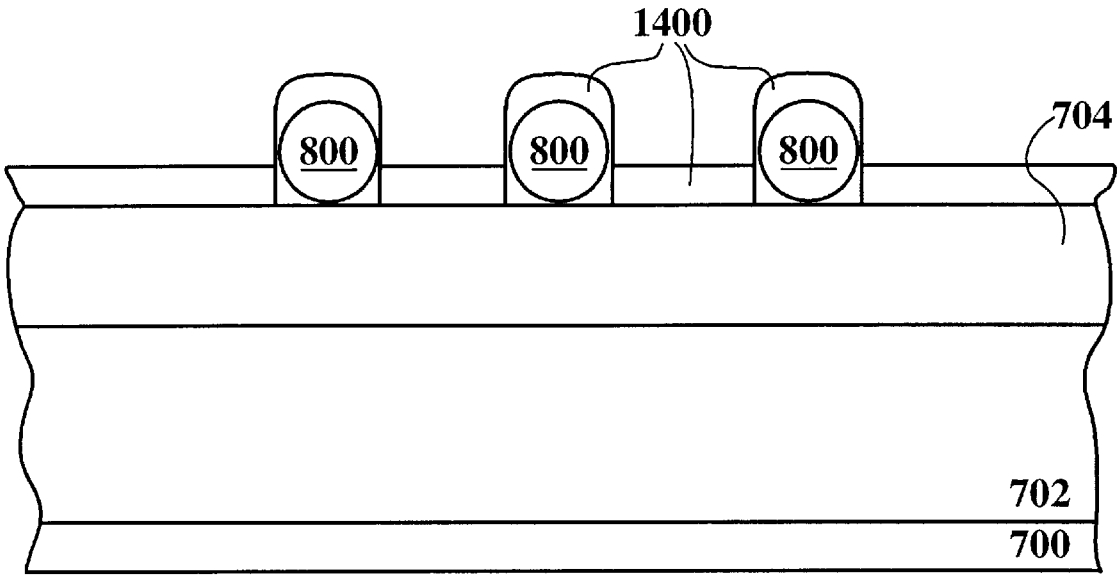
FIGS. 14–20 are side sectional view illustrating steps employed in the formation of a gate electrode in accordance with the present claimed invention.

Referring now to FIG. 14, after the deposition of particles 800, the present invention deposits a sacrificial "hard mask layer" 1400 over polymer particles 800 and layer 704. In the present invention, hard mask layer 1400 is comprised of a material which has a significantly lower etch rate than the gate metal when subjected to a plasma etch environment used to etch the gate metal. That is, the sacrificial hard mask layer of the present invention is comprised of a material which is not adversely affected/substantially etched during the etching of the gate metal or other layers of the present structure. In the present embodiment, hard mask layer 1400 is comprised of aluminum. Although aluminum is recited as the material of hard mask layer 1400 in the present embodiment, the present invention is also well suited to the use of various other materials such as, for example, nickel, chromium, and the like. The choice of the hard mask layer is dependent upon the material comprising the various layers of the structure (i.e. the material comprising the row electrode, the resistive layer, the dielectric, the gate electrode, and the like). Additionally, in the present embodiment, hard mask layer 1400 has a thickness of approximately 200–1000 angstroms.

Figure 15:
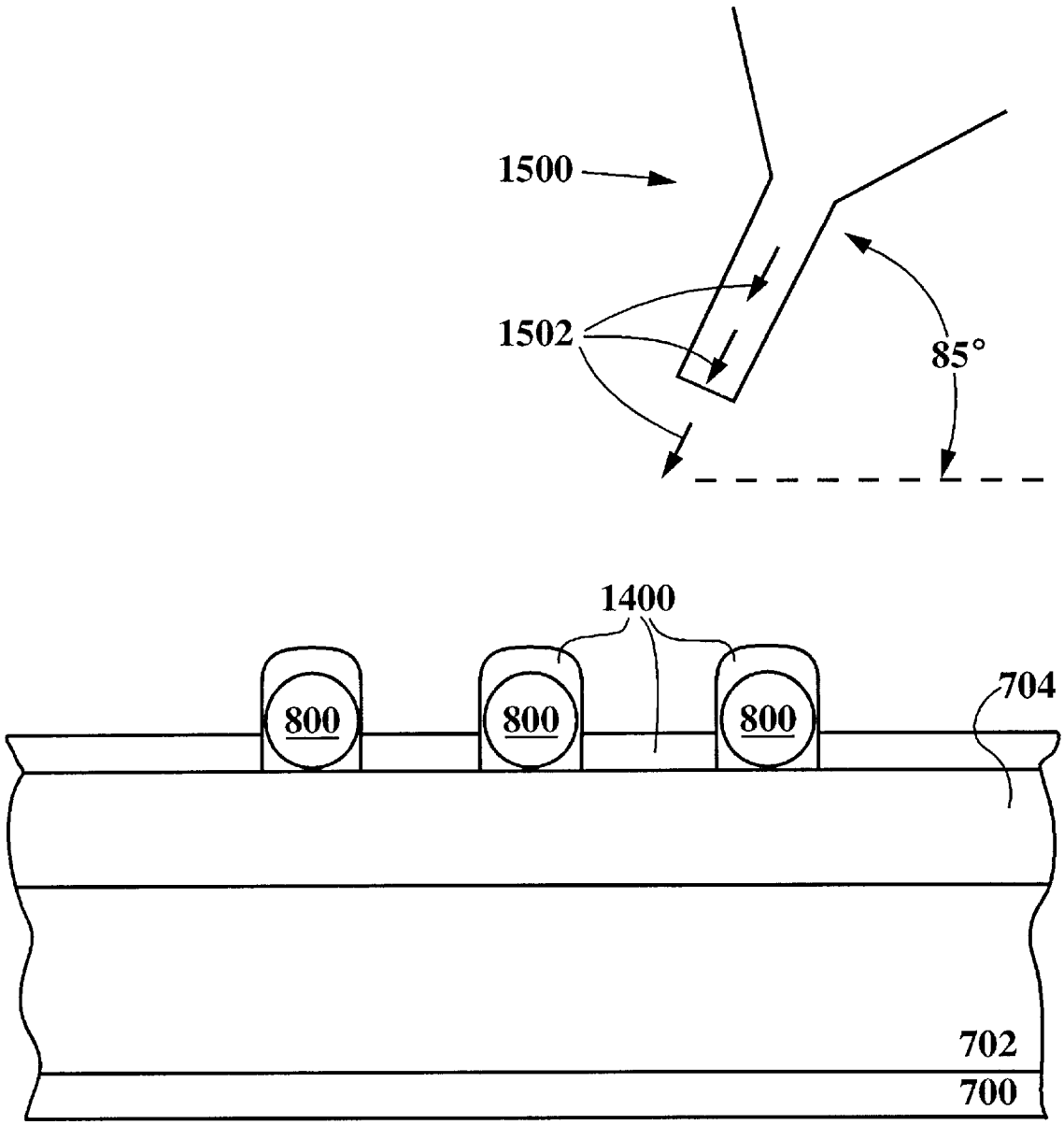

With reference next to FIG. 15, in this embodiment of the present invention, polymer particles 800 are removed by subjecting polymer particles 800 to a high pressure fluid spray. As shown in FIG. 15, a nozzle 1500 directs a high pressure spray at the surface of layer 704. In the present embodiment, nozzle 1500 directs a spray of deionized water, at a pressure of approximately 2500 pounds per square inch or less, towards surface 704 at an angle of approximately 85 degrees with respect to surface 704. Although such a specific angle and pressure is recited in the present embodiment, the present invention is well suited to the use of various other pressures and angles. The pressure and angle at which the deionized water is directed at surface 704 is varied according to the distance of nozzle 1500 from surface 704. In so doing, the present invention removes polymer particles 800 and those portions of hard mask layer 1400 which overlie polymer particles 800. The present invention is also well suited to removing particles 800 from the surface of layer 704 by subjecting particles 800 to a high pressure fluid spray in conjunction with a brushing (contact or non-contact) of particles 800. Thus, the high pressure spraying process of the present invention removes spheres 800 from the surface of layer 704 without requiring the use of harsh and/or caustic materials. As a result, the present invention does not damage or subject various other layers to detrimental processes. After the high pressure spray, the present invention dries the structure using a spin-dry process.

Figure 16:
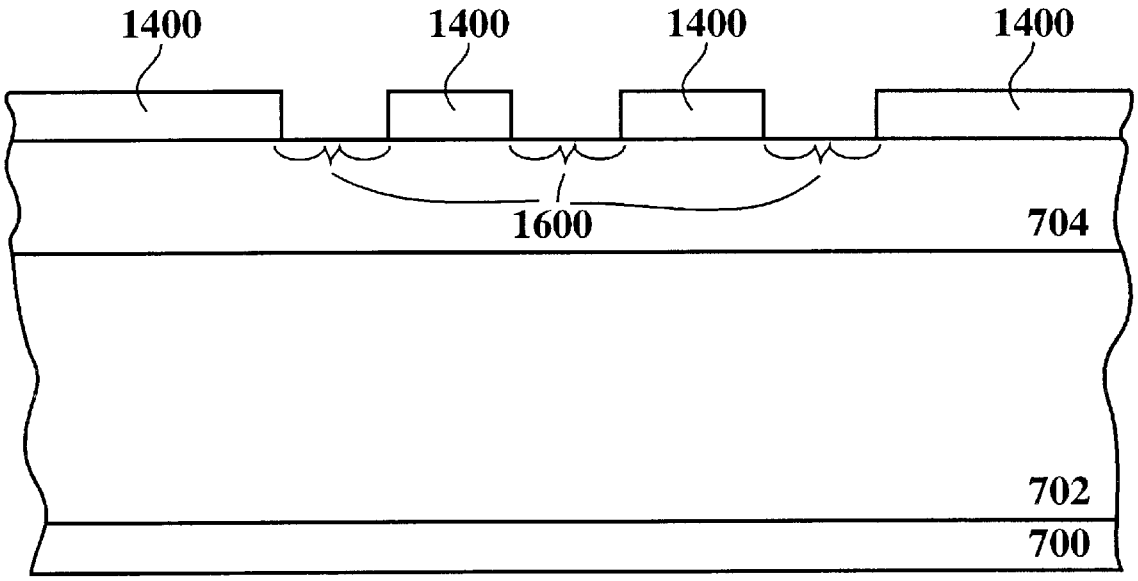

Referring now to FIG. 16, as a result of the above-described high pressure spray process, the present invention exposes first regions 1600 of layer 704. The remaining portions (i.e. second regions of layer 704) remain covered by hard mask layer 1400.

Figure 17:
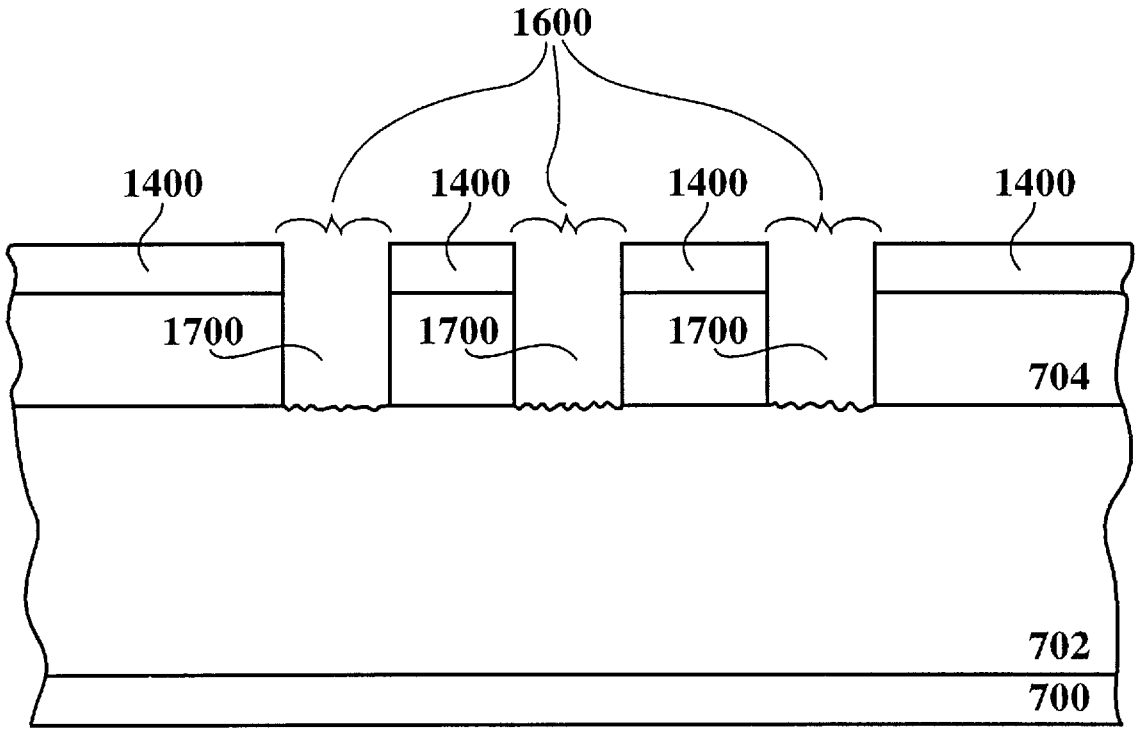

Referring next to FIG. 17, the present invention then etches through first regions 1600 of layer 704 such that openings, typically shown as 1700, are formed completely through layer 704. In an embodiment where layer 704 is comprised of chromium, a chlorine and oxygen-containing etch environment is used to form openings 1700. In such an embodiment, the structure is subjected to a plasma etch environment comprising: a power of 500 watts; a bottom electrode bias of 20 watts; a temperature of 60 Celsius; and a pressure of 10–20 milliTorr for a period of approximately 40 seconds. In an embodiment where layer 704 is comprised of tantalum, a fluorine-containing etch environment (e.g. $CHF_3/CF_4$) is used to form openings 1700. In such an embodiment, the structure is subjected to a plasma etch environment comprising: a power of 400 watts; a bottom electrode bias of 80 watts; a temperature of 60 Celsius; and a pressure of 15 milliTorr for a period of approximately 160 seconds. The present invention is, however, well suited to varying the parameters of the plasma etch environment.

Referring still to FIG. 17, during the etching of openings 1700, hard mask layer 1400 of the present invention protects the underlying top surface of layer 704 from the plasma environment. Thus, unlike conventional gate electrode formation processes, the present invention protects the top surface of layer 704 from, for example, oxidation. Hence, in the present invention, the condition of the top surface of layer 704 does not complicate other processes such as the removal of subsequently deposited emitter material. Therefore, the present invention provides a gate electrode which has an undamaged top surface and which has good surface integrity.

Figure 18:
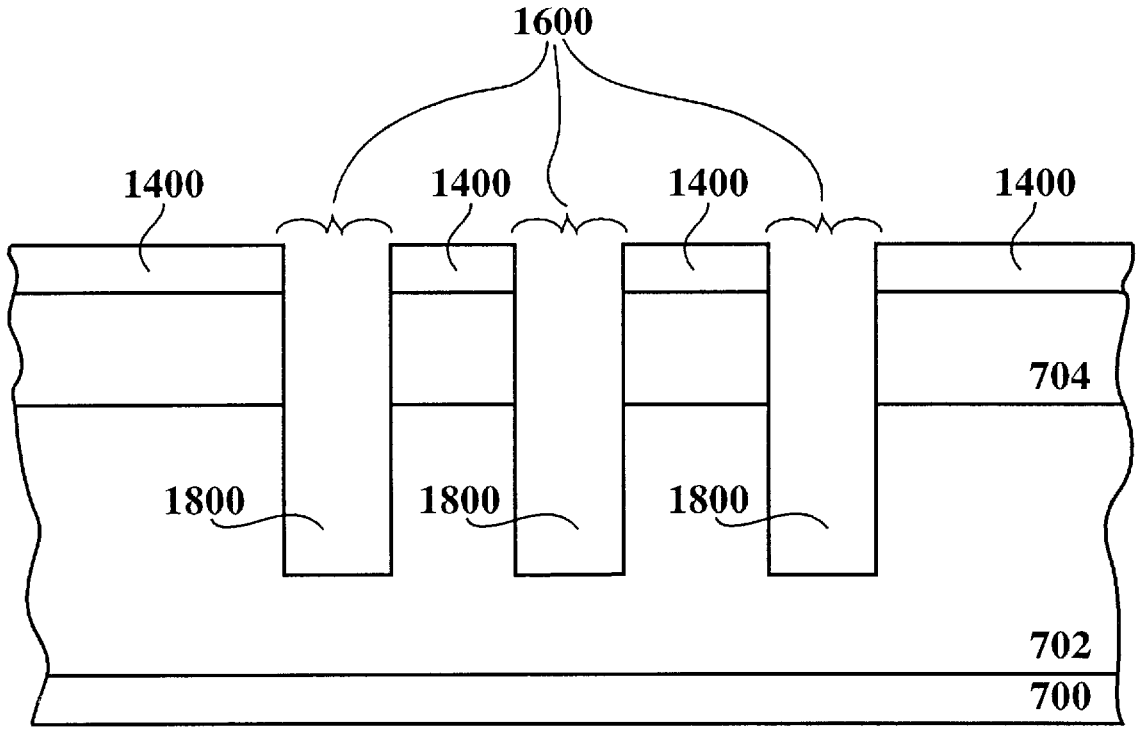

With reference now to FIG. 18, the present invention then etches through a substantial amount of the thickness of underlying substrate 702. In an embodiment where layer 704 is comprised of chromium and a chlorine and oxygen-containing etch environment was used to form openings 1700, the structure is then subjected to another etch environment which contains fluorine (e.g. $CHF_3/CF_4$). The fluorine etch environment is used to etch cavities 1800 in underlying substrate 702. In the present invention the change from the chlorine and oxygen-containing etch environment to the fluorine containing etch environment is made without breaking the vacuum of the etch environment. In an embodiment where layer 704 is comprised of tantalum and a fluorine-containing etch environment was used to form openings 1700, the same fluorine etch environment is used to etch cavities 1800 in underlying substrate 702.

With reference again to FIG. 18, during the etching of cavities 1800, hard mask layer 1400 continues to protect the underlying top surface of layer 704 from the plasma environment. Thus, unlike conventional gate electrode formation processes, the present invention protects the top surface of layer 704 from, for example, oxidation.

Figure 19:
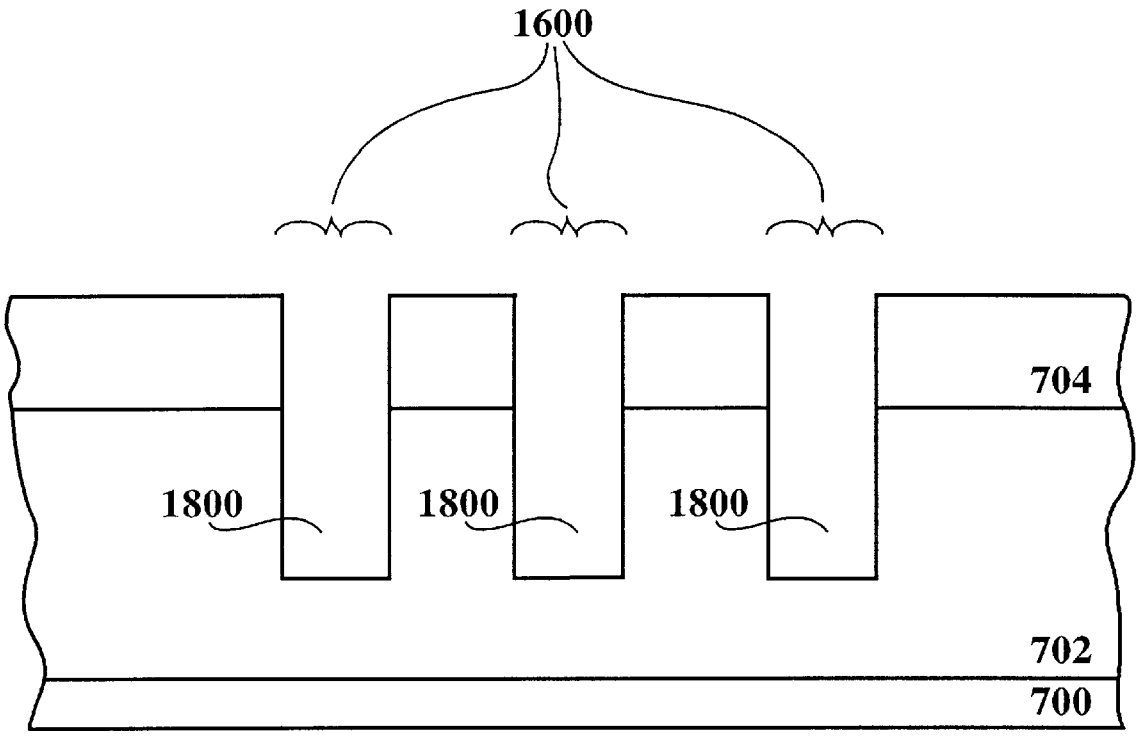

Referring now to FIG. 19, the present invention then removes remaining portions of hard mask layer 1400 which overlie the second regions of layer 704. Thus, hard mask layer 1400 protects the top surface of layer 704 during the etching of both layer 704 and underlying substrate 702. As a result, unlike prior art gate electrodes, the top surface of a gate electrode formed according to the present invention remains in pristine condition even after numerous etch steps. In the present embodiment, hard mask layer 1400 is removed using a selective wet etch comprised of approximately 10 percent sodium hydroxide. Hard mask layer 1400 can also be removed using various other etchants, however.

Figure 20:
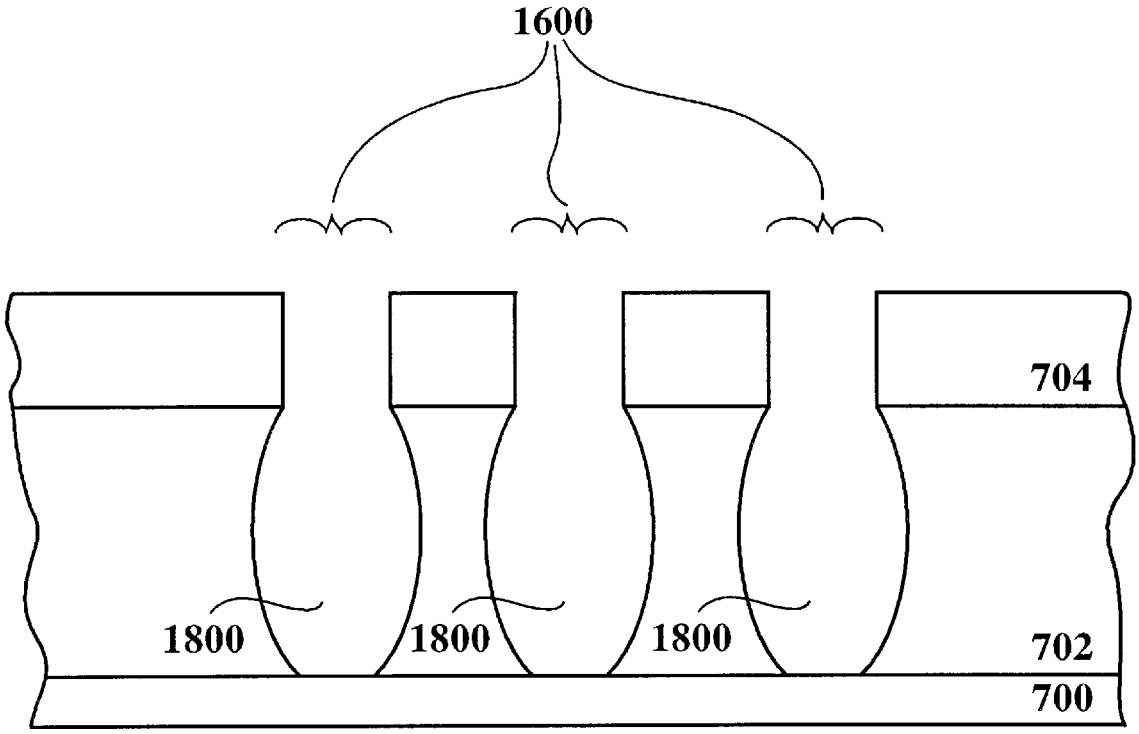

With reference next to FIG. 20, after the removal of hard mask layer 1400, the present invention removes the remaining underlying substrate 702 and enlarges cavities 1800 formed in underlying substrate 702 by exposing cavities 1800 to a wet etchant. Hence, a gate electrode and corresponding underlying cavities have been formed by the present embodiment of this invention. By eliminating many of the disadvantages associated with conventional gate electrode formation processes, the present invention increases yield, improves throughput, and reduces the costs required to form a gate electrode. Alternately, it is conceivable, for certain types of materials, that hard mask layer 1400 can be removed during the wet etch (i.e. during the enlargement) of the cavities.

Thus, the present invention provides a gate electrode formation method which achieves uniform deposition of spheres. The present invention also provides a gate electrode formation process which removes the substrate from a fluid bath without resulting in deleterious settling of loose spheres onto the surface of the layer of the gate metal. The present invention further provides a method which does not require the use of harsh and/or caustic materials to remove the spheres from the surface of the layer of the gate metal.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order best to explain the principles of the invention and its practical application, to thereby enable others skilled in the art best to utilize the invention and various embodiments with various modifications suited to the particular use contemplated. It is intended that the scope of the invention be defined by the Claims appended hereto and their equivalents.

What is claimed is:

1. A method for uniformly depositing polymer particles onto the surface of a gate metal during the formation of a gate electrode, said method comprising the steps of:

a) immersing a substrate having a layer of a gate metal disposed over the surface thereof in a fluid bath containing polymer particles, said fluid bath contained within a fluid bath tank;

b) depositing said polymer particles onto said layer of said gate metal with a spatial density of approximately $1\times10^8$ to $1\times10^{12}$ particles per square centimeter such that said polymer particles are uniformly deposited over the surface of said layer of said gate metal; and c) removing said substrate having said layer of said gate metal and said particles deposited thereon from said fluid bath.

2. The method as recited in claim 1 for uniformly depositing polymer particles onto the surface of a gate metal as recited in step a) wherein:

said layer of said gate metal disposed over said substrate has a thickness approximately the same as a desired thickness of said gate electrode.

3. The method as recited in claim 1 for uniformly depositing polymer particles onto the surface of a gate metal wherein step b) further comprises:

applying a uniform potential across said surface of said layer of said gate metal such that said polymer particles are uniformly deposited onto said layer of gate metal.

4. The method as recited in claim 1 for uniformly depositing polymer particles onto the surface of a gate metal wherein step b) further comprises:

adhering said polymer particles to said layer of said gate metal via a charge difference between said layer of said gate metal and each respective one of said polymer particles.

5. A method for uniformly depositing polymer particles onto the surface of a gate metal and subsequently removing a portion of said polymer particles during the formation of a gate electrode, said method comprising the steps of:

a) immersing a substrate having a layer of a gate metal disposed over the surface thereof in a fluid bath containing polymer particles, said fluid bath contained within a fluid bath tank;

b) depositing said polymer particles onto said layer of said gate metal with a spatial density of approximately $1\times10^8$ to $1\times10^{12}$ particles per square centimeter such that said polymer particles are uniformly deposited over the surface of said layer of said gate metal;

c) removing said substrate having said layer of said gate metal and said particles deposited thereon from said fluid bath;

e) depositing a hard mask layer over said polymer particles and said layer of said gate metal; and f) directing a high pressure spray at said surface of said layer of said gate metal to remove said polymer particles and portions of said hard mask layer which overlie said polymer particles such that first regions of said layer of said gate metal are exposed, and such that second regions of said layer of said gate metal remain covered by said hard mask layer.

6. The method as recited in claim 5 for uniformly depositing polymer particles onto the surface of a gate metal and subsequently removing a portion of said polymer particles as recited in step a) wherein:

said layer of said gate metal disposed over said substrate has a thickness approximately the same as a desired thickness of said gate electrode.

7. The method as recited in claim 5 for uniformly depositing polymer particles onto the surface of a gate metal and subsequently removing a portion of said polymer particles wherein step b) further comprises:

adhering said polymer particles to said layer of said gate metal via a charge difference between said layer of said gate metal and each respective one of said polymer particles.

8. The method as recited in claim 5 for uniformly depositing polymer particles onto the surface of a gate metal and subsequently removing a portion of said polymer particles wherein step b) further comprises:

applying a uniform potential across said surface of said layer of said gate metal such that said polymer particles are uniformly deposited onto said layer of gate metal.

9. The method as recited in claim 5 for uniformly depositing polymer particles onto the surface of a gate metal and subsequently removing a portion of said polymer particles wherein step d) further comprises:

maintaining a constant vapor pressure in said fluid bath tank while draining said fluid bath from said fluid bath tank.

10. The method as recited in claim 9 for uniformly depositing polymer particles onto the surface of a gate metal and subsequently removing a portion of said polymer particles wherein step d) further comprises:

maintaining said constant vapor pressure in said fluid bath tank by controlling the rate at which said fluid bath is drained from said fluid bath tank.

11. The method as recited in claim 9 for uniformly depositing polymer particles onto the surface of a gate metal and subsequently removing a portion of said polymer particles wherein step d) further comprises:

maintaining said constant vapor pressure in said fluid bath tank by introducing a gas into said fluid bath tank during said draining of said fluid bath from said fluid bath tank.

12. The method as recited in claim 5 for uniformly depositing polymer particles onto the surface of a gate metal and subsequently removing a portion of said polymer particles wherein step f) further comprises:

directing a high pressure spray of deionized water at said surface of said layer of said gate metal.

13. The method as recited in claim 12 for uniformly depositing polymer particles onto the surface of a gate metal and subsequently removing a portion of said polymer particles wherein step f) further comprises:

directing said high pressure spray of deionized water towards said surface of said layer of said gate metal at an angle of 85 degrees with respect to surface of said layer of said gate metal.

14. A method for forming uniformly spaced openings in a gate electrode, said method comprising the steps of:

a) depositing a gate metal over an underlying substrate such that a layer of said gate metal is formed above said underlying substrate, said layer of said gate metal deposited to a thickness approximately the same as a desired thickness of said gate electrode;

b) immersing said substrate and said layer of said gate metal in a fluid bath containing polymer particles, said fluid bath contained within a fluid bath tank;

c) depositing said polymer particles onto said layer of said gate metal with a spatial density of approximately $1\times10^8$ to $1\times10^{12}$ particles per square centimeter such that said polymer particles are uniformly deposited over the surface of said layer of said gate metal;

d) removing said substrate having said layer of said gate metal and said particles deposited thereon from said fluid bath;

e) depositing a hard mask layer over said polymer particles and said layer of said gate metal;

f) directing a high pressure spray at said surface of said layer of said gate metal to remove said polymer particles and portions of said hard mask layer which overlie said polymer particles such that first regions of said layer of said gate metal are exposed, and such that second regions of said layer of said gate metal remain covered by said hard mask layer;

g) etching into said first regions of said layer of said gate metal such that substantially uniformly spaced openings are formed into said layer of said gate metal at said first regions, said second regions of said layer of said gate metal protected from said etching by said hard mask layer; and h) removing remaining portions of said hard mask layer which overlie said second regions of said layer of said gate metal.

15. The method for forming a gate electrode as recited in claim 14 wherein step b) further comprises:

applying a uniform potential across said surface of said layer of said gate metal such that said polymer particles are uniformly deposited onto said layer of gate metal.

16. for forming a gate electrode as recited in claim 14 wherein step c) further comprises:

adhering said polymer particles to said layer of said gate metal via a charge difference between said layer of said gate metal and each respective one of said polymer particles.

17. The method for forming a gate electrode as recited in claim 14 wherein step d) further comprises:

maintaining a constant vapor pressure in said fluid bath tank while draining said fluid bath from said fluid bath tank.

18. The method for forming a gate electrode as recited in claim 17 wherein step d) further comprises:

maintaining said constant vapor pressure in said fluid bath tank by controlling the rate at which said fluid bath is drained from said fluid bath tank.

19. The method for forming a gate electrode as recited in claim 17 wherein step d) further comprises:

maintaining said constant vapor pressure in said fluid bath tank by introducing a gas into said fluid bath tank during said draining of said fluid bath from said fluid bath tank.

20. The method for forming a gate electrode as recited in claim 14 wherein step f) further comprises:

directing a high pressure spray of deionized water at said surface of said layer of said gate metal.

21. The method for forming a gate electrode as recited in claim 20 wherein step f) further comprises:

directing said high pressure spray of deionized water towards said surface of said layer of said gate metal at an angle of 85 degrees with respect to surface of said layer of said gate metal.

* * * * *